US006691873B1

(12) United States Patent
Healey

(10) Patent No.: US 6,691,873 B1
(45) Date of Patent: Feb. 17, 2004

(54) ONE-PIECE DISPENSER CARTON

(75) Inventor: Frederick A. Healey, Plymouth, MI (US)

(73) Assignee: Lit-Pac, Inc., Taylor, MI (US)

( * ) Notice: Subject to any disclaimer, the term of this patent is extended or adjusted under 35 U.S.C. 154(b) by 158 days.

(21) Appl. No.: 10/074,611

(22) Filed: Feb. 12, 2002

(51) Int. Cl.[7] ..... B65D 85/48

(52) U.S. Cl. ..... 206/494; 206/457; 206/768; 229/240

(58) Field of Search ..... 206/45.28, 45.29, 206/438, 440, 457, 494, 766, 767, 768; 40/124.08, 124.14, 539; 229/116.1, 118, 122.32, 164, 240

(56) References Cited

U.S. PATENT DOCUMENTS 1,472,953 A 11/1923 Bamber
4,413,769 A * 11/1983 Michetti ..... 206/494
4,860,886 A * 8/1989 Northrup et al. ..... 206/45.29
5,317,823 A 6/1994 Brunt, II
5,657,872 A * 8/1997 Leftwich et al. ..... 229/240
5,657,875 A * 8/1997 Hirsh et al. ..... 206/767
5,682,999 A * 11/1997 Larson ..... 206/768
5,738,221 A 4/1998 Van Witt et al.
5,983,538 A 11/1999 Crowell
6,158,579 A * 12/2000 Rosenbaum ..... 206/45.29

* cited by examiner

*Primary Examiner*—Luan K. Bui
(74) *Attorney, Agent, or Firm*—Michael Best & Friedrich LLP

(57) ABSTRACT

This invention provides an improved one-piece displace device and folding carton. The carton can be shipped in a relatively flat configuration, but folds to a useful and interesting three-dimensional shape. The carton can dispense tissue papers, paper towels or surgical gloves, among other things. The carton may include a diorama or a pop-up display.

24 Claims, 10 Drawing Sheets

ONE-PIECE DISPENSER CARTON

BACKGROUND OF THE INVENTION

This invention generally relates to an improved one-piece display device and folding carton. The art of folding sheets of material such as, for example, paper or cardboard is ancient and widely practiced. For example, U.S. Pat. No. 1,472,953 issued to Bamber describes the construction of a folding box which is to be used for displaying an advertisement. However, the folding box of the Bamber patent does not provide a three-dimensional advertising display. Additionally, the folding box of the Bamber patent provides very little protection for its contents when the advertisement is displayed.

U.S. Pat. No. 5,317,823 issued to Brunt, II describes a three-dimensional pop-up display which reportedly may be used for temporarily inserting a product, such as a compact disc, into the display. However, the display of the Brunt, II patent does not provide relatively permanent protection for the products.

U.S. Pat. No. 5,738,221 issued to Van Witt et al. describes a compact disc holder package containing a three-dimensional pop-up display. However, the package of the Van Witt et al is not made of a foldable material, rather it is a pop-up display placed in a conventional package.

U.S. Pat. No. 5,983,538 issued to Crowell describes a method for individually creating three-dimensional displays. However, the display of the Crowell patent is assembled from separate pieces, rather than being produced in one piece from a single sheet of material.

Accordingly, a need still exists for an improved three-dimensional display device and foldable container which is made in one piece from a single sheet of foldable material.

SUMMARY OF THE INVENTION

The invention provides an improved one-piece display device and folding carton. The carton can be shipped in a relatively flat configuration, but folds to a useful and interesting three-dimensional shape. The carton can dispense tissue papers, paper towels or surgical gloves, among other things. The carton may include a diorama or a pop-up display.

In a preferred aspect, the invention is an improved display device and folding carton, which comprises two end panels, a front panel, a bottom panel, a rear panel, a top panel, and a projecting panel. The top panel includes a front edge, and a plurality of support tabs extending outwardly from the top panel front edge. Each of the support tabs has an outward edge terminating in a score line.

The projecting panel has a bottom edge and a support flap extending outwardly from the projecting panel bottom edge, the projecting panel being foldably connected to at least one of the plurality of support tabs along the score line of the respective support tab. The projecting panel support flap is of suitable size and strength for attaching the projecting panel support flap to the bottom panel so as to align the projecting panel in a spaced apart from and substantially parallel position relative to the front panel. The panels are all formed in one piece of material and interconnected with each other to form a substantially continuous carton in the shape of a right, rectangular, truncated prism. The front panel serves as a recessed backdrop for projecting panel, and the two panels cooperate to produce a diorama or shadow box effect.

In another preferred aspect, the invention is an improved display device and folding carton which comprises two end panels, a front panel, a bottom panel, a rear panel, a top panel, and a projecting panel. The above-described panels are all formed from one continuous sheet of foldable material and interconnected with each other to form a substantially continuous carton in the shape of right rectangular prism. The front panel 10 serves as a recessed backdrop for projecting panel 60, and the two panels cooperate to produce a diorama or shadow box effect.

In yet another preferred aspect, the invention is an improved display device and folding carton which includes a foldable pop-up display. The carton including the pop-up display is formed in one piece from a single sheet of foldable material.

In still another preferred aspect, the invention is invention is an improved display device and folding carton which can be shipped in a relatively flat configuration but folds to produce a three-dimensional carton configuration in the shape of a right, octagonal, truncated prism.

DETAILED DESCRIPTION OF PREFERRED ASPECTS OF THE INVENTION

Figure 1:
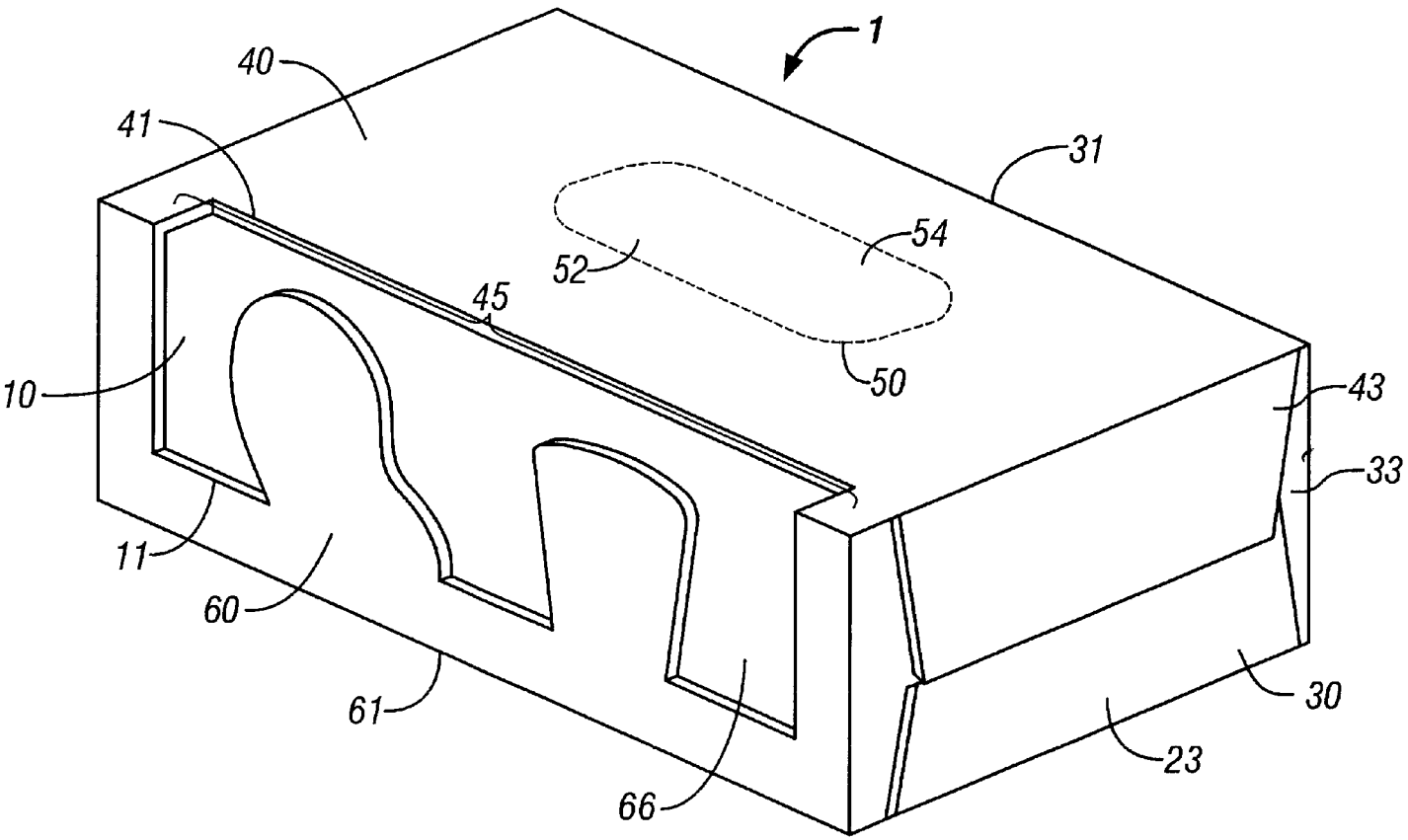
FIG. 1 is a perspective view of an improved display device and foldable carton of the present invention in an upright configuration.

In a preferred embodiment, the invention is an improved display device and folding carton 1, as depicted in FIGS. 1 through 4. Carton 1 may be constructed of a single sheet of cardboard or other foldable material. Carton 1 includes front panel 10, which serves as a recessed backdrop for projecting panel 60. Front panel 10 includes front panel top edge 16 and front panel bottom edge 11. Substantially linear score line, 14 runs along top panel top edge 16. Front panel bottom edge score line 17 is also substantially linear and runs along front panel bottom edge 11. Front panel top edge score line 14 and front panel bottom edge score line 17 facilitate folding of carton 1 from a single sheet of material during manufacturing carton 1. Front panel 10 additionally includes front panel closure flap 18, which extends outwardly from the front panel top edge 16. Front panel bottom edge score line 17 delineates the border of front panel closure flap 18 with front panel 10. Front panel bottom edge 11 is foldably joined through front panel top edge score line 14 to bottom panel 20.

For the present purposes, top, bottom, front and rear refer to portions of carton 1 as they are normally oriented while carton 1 is being utilized as a dispenser. For example, front panel 10 is oriented toward the front portion of carton 1 during normal use as a dispenser. As another example, front panel bottom edge 11 is the edge of front panel 10 which located toward the bottom of carton 1 during normal use as a dispenser.

Figure 2:
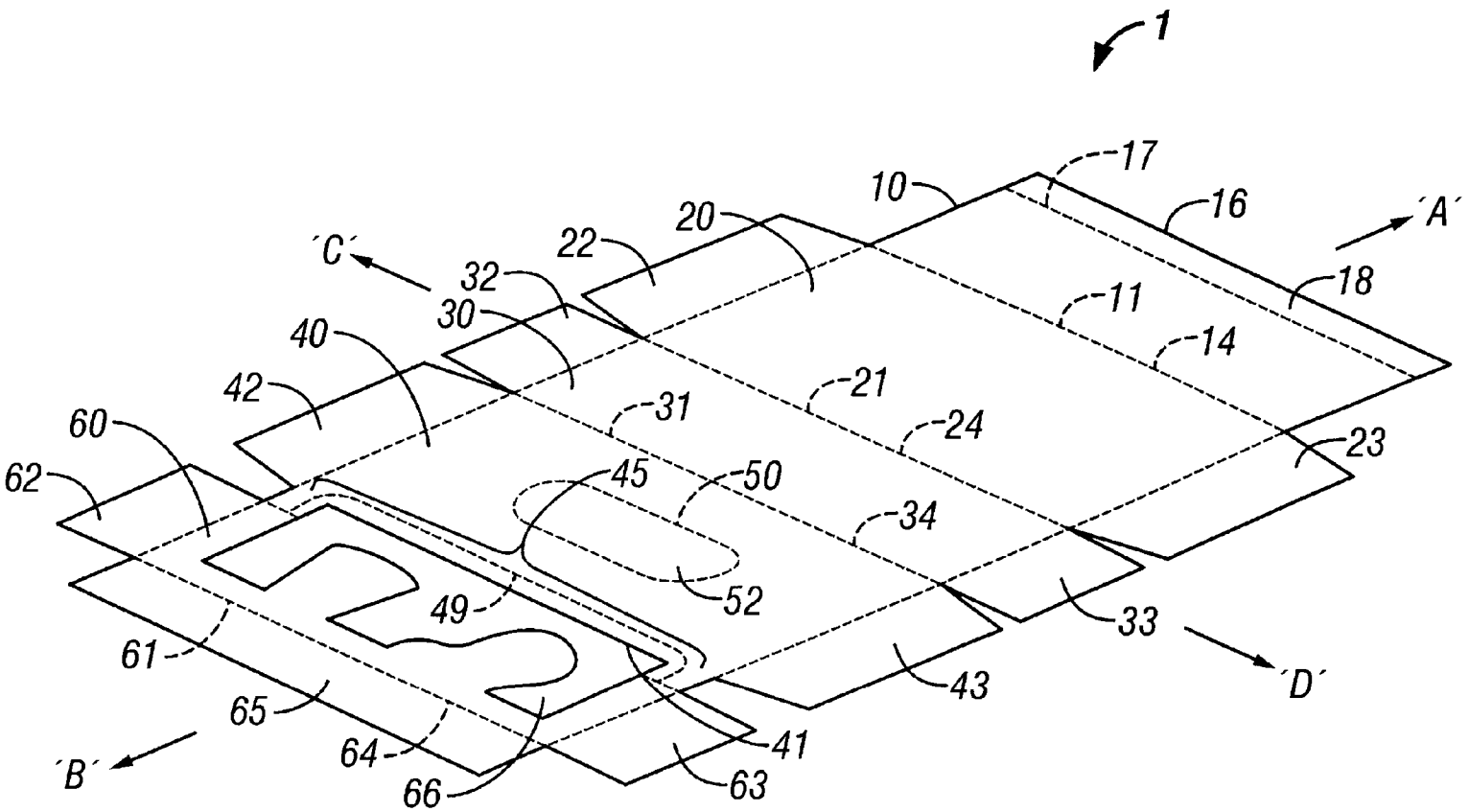
FIG. 2 is a perspective view of an improved display device and foldable carton of the present invention in a blank configuration.

In contrast, laterally extending means extending in direction C or direction D, as depicted in FIG. 2, relative to the carton 1 in a fully extended, relatively flat configuration in which carton 1 is initially stamped from a single sheet of material during manufacturing. This fully extended, relatively flat configuration is commonly referred to as a blank configuration. A carton in this configuration is sometimes referred to as a blank. Frontwardly refers to the direction designated direction A in FIG. 2. Backwardly refers to the direction designated direction B shown in FIG. 2.

Bottom panel 20 includes rear edge 21 and a pair of laterally extending bottom panel closure flaps (22 and 23) Bottom panel 20 also includes bottom panel score line 24, which is substantially linear and runs along bottom panel rear edge 21. Bottom panel score line 24 foldably joins bottom panel 20 to rear panel 30.

Rear panel 30 includes bottom panel rear edge 31 and a pair of laterally extending rear panel closure flaps (32 and 33). Bottom panel 30 also includes bottom panel score line 34, which is substantially linear and runs along bottom panel rear edge 31. Rear panel score line 34 foldably joins rear panel 30 to top panel 40.

Top panel 40 includes top panel front edge 41, and a plurality of support tabs 45 extending outwardly, preferably backwardly, from top panel 40. Top panel 40 is cut or perforated to produce a frangible web 50, which circumscribes and defines a detachable barrier 52. Frangible web 50 also circumscribes and defines a portal 54, which is substantially obstructed by detachable portion 52 until detachable portion 52 is removed by breaking fragible web 50. Detachable portion 52 serves as a gate or door to portal 54 to retain the contents of carton 51 until the user desires access to the cintents of carton 1. The contents may be, for example, shoes, paper towels or plastic surgical gloves. When the user desires access to the contents of the carton 1, the user grasps detachable portion 52 and pulls it away from top panel 40 to at least partially break frangible web 50.

Top panel 40 additionally includes a pair of laterally extending top panel closure flaps (42 and 43). Top panel support tabs 45 each have an outward edge terminating in a support tab score line 49. Preferably, front panel closure flap 18 is of suitable size and sufficient strength for attaching and foldably connecting front panel 10 to top panel 40 along top panel front edge score line 17. In a configuration which is as depicted in FIG. 1, front panel closure flap 18 joins front panel 10 to top panel 40 by means of an adhesive (not shown).

Projecting panel 60 includes a projecting panel bottom edge 61, a pair of laterally extending projecting panel closure flaps 62 and 63, and a substantially linear projecting panel bottom edge score line 64, which runs along the projecting panel bottom edge. Support flap 65 extends outwardly, preferably backwardly, from projecting panel bottom edge 61. Projecting panel 60 is foldably connected to at least one of the plurality of support tabs 45, along the respective support tab score line 49. Projecting panel support flap 65 is of suitable size and strength for attaching to bottom panel 20 so as to align projecting panel 60 in a spaced apart from and substantially parallel position relative to front panel 10.

Projecting panel top edge 64 cooperates with top panel front edge 41 to defines a cutout area 66. Preferably, projecting panel top edge 64 is not substantially linear. Most preferably, projecting panel top edge 64 is curved and angled to form shapes which are useful or decorative. Front panel 10, being spaced apart from the substantially parallel to projecting panel 60, serves as a backdrop for cutout area 66. Projecting panel 60 and front panel 10 cooperate as foreground and background of a diorama or shadow box. For the present purposes, diorama means a miniature scene, wholly or partially three dimensional of the kind, for example, generally displayed in a small, shallow case called a shadow box.

The closure flaps (18, 22, 23, 32, 33, 42, 43, 62, 63) and support flap 65 are preferably treated in advance of assembly with adhesive. Most preferably, the adhesive is in the form of an adhesive strip (not shown).

Figures 3A, 3B, 3C, 3D, 3E, 3F, 3G:
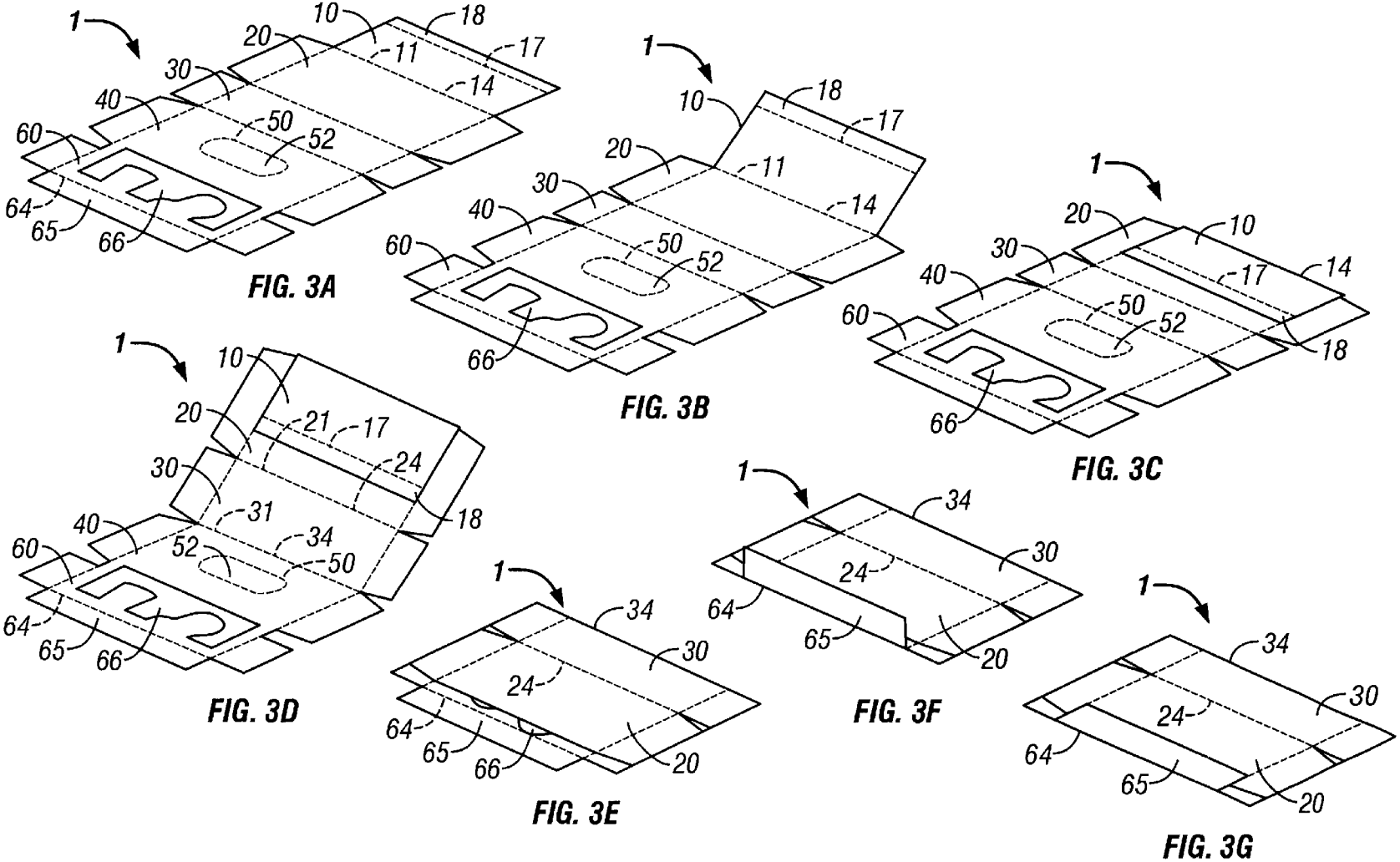
FIGS. 3A–3G are a composite perspective view showing an improved display device and foldable carton of the present invention in various relatively flat configurations.

Carton 1 is employed by the user in upright form as shown in FIG. 1; however, carton 1 is preferably formed as a single sheet, as shown in FIG. 2, during the manufacturing process. FIG. 3, including FIGS. 3A through 3G, communicates various operations and intermediate configurations which served to transform carton 1 from the fully extended, relatively flat configuration shown in FIG. 3A into the upright configuration shown in FIG. 3G.

Turning now to FIG. 3A, carton 1 is created by stamping a single sheet of material to form frangible web 50, cutout 66, and the various tabs, flaps and score lines which constitute carton 1 in the fully extended, relatively flat configuration. FIG. 3B shows carton 1 being folded along front panel top edge score line 14, which runs along front panel top edge 11. FIG. 3C shows the completed fold along front panel top edge score line 14 with carton 1 in a relatively flat, intermediate configuration which is suitable for shipping.

FIG. 3D shows carton 1 again being folded, this time along rear panel top edge score line 34, which runs along rear panel top edge 31. FIG. 3E depicts carton 1 as seen after the fold is completed. This places carton 1 is in another relatively flat, intermediate configuration suitable for shipping.

FIG. 3F shows carton 1 being folded along projecting panel top edge 64. FIG. 3G shows carton 1 after completion of the fold along projecting panel top edge 64, in another relatively flat, intermediate configuration.

Figure 4A:
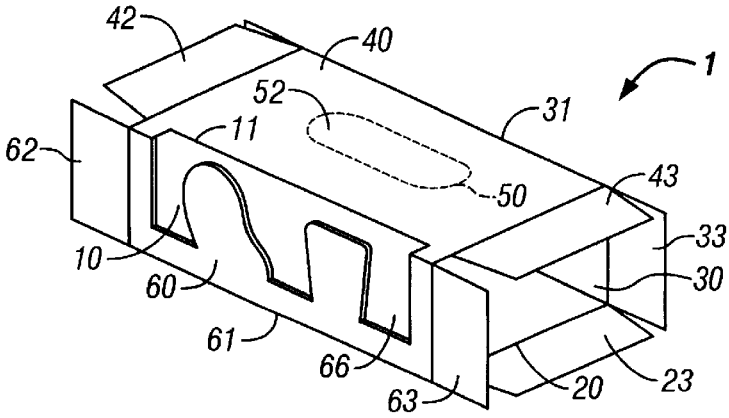
FIGS. 4A–4D are composite perspective view showing an improved display device and foldable carton of the present invention in upright.
Figure 4B:
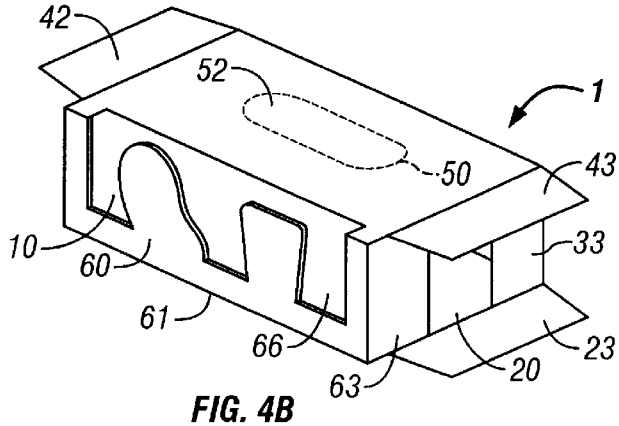
Figure 4C:
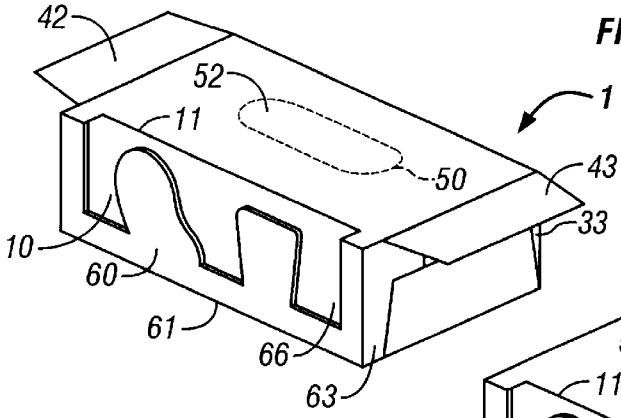
Figure 4D:
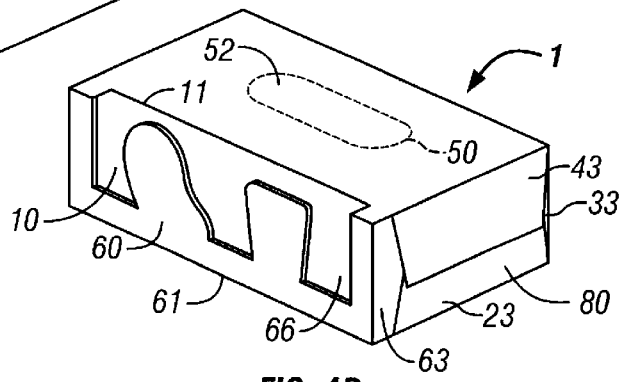

FIG. 4A shows carton 1 in upright form, with all laterally extending closure flaps free to move independently. FIG. 4B conveys the manner in which rear panel closure flaps (32 and 33), and projecting panel closure flaps (62 and 63) are folded along score lines 34 and 64, respectively. FIG. 4C shows bottom panel closure flaps (22 and 23) folded. FIG. 4D shows top panel closure flaps (42 and 43 folded to complete the assembly of end panels (70 and 80, respectively).

Inspection of FIGS. 3A through 3F reveals that carton 1 may be shipped in several relatively flat configurations in which front panel closure flap 18 is foldably attached to top panel 40, and joined to front panel 10 with top panel 40 along top panel front edge 41. Moreover, FIG. 3G demonstrates that projecting panel support flap 65 is attached to bottom panel 20 in at least one relatively flat configuration. Both FIG. 3E and FIG. 3G depict relatively flat configurations of carton suitable for shipping in which bottom panel 20 and rear panel 30 are substantially co-planar. FIG. 3A indicates that carton 1 may be shipped in a relatively flat configuration in which top panel 40 and rear panel 30 are substantially co-planar.

Practitioners will appreciate that the configuration of carton 1 depicted in FIG. 3G may be readily transformed into the configuration depicted in FIG. 4A by merely rotating the panels (10, 20, 30, 40 and 60) with respect to each other about their respective foldably-joined score lines (14, 17, 24, 34, 49 and 64).

Figure 5:
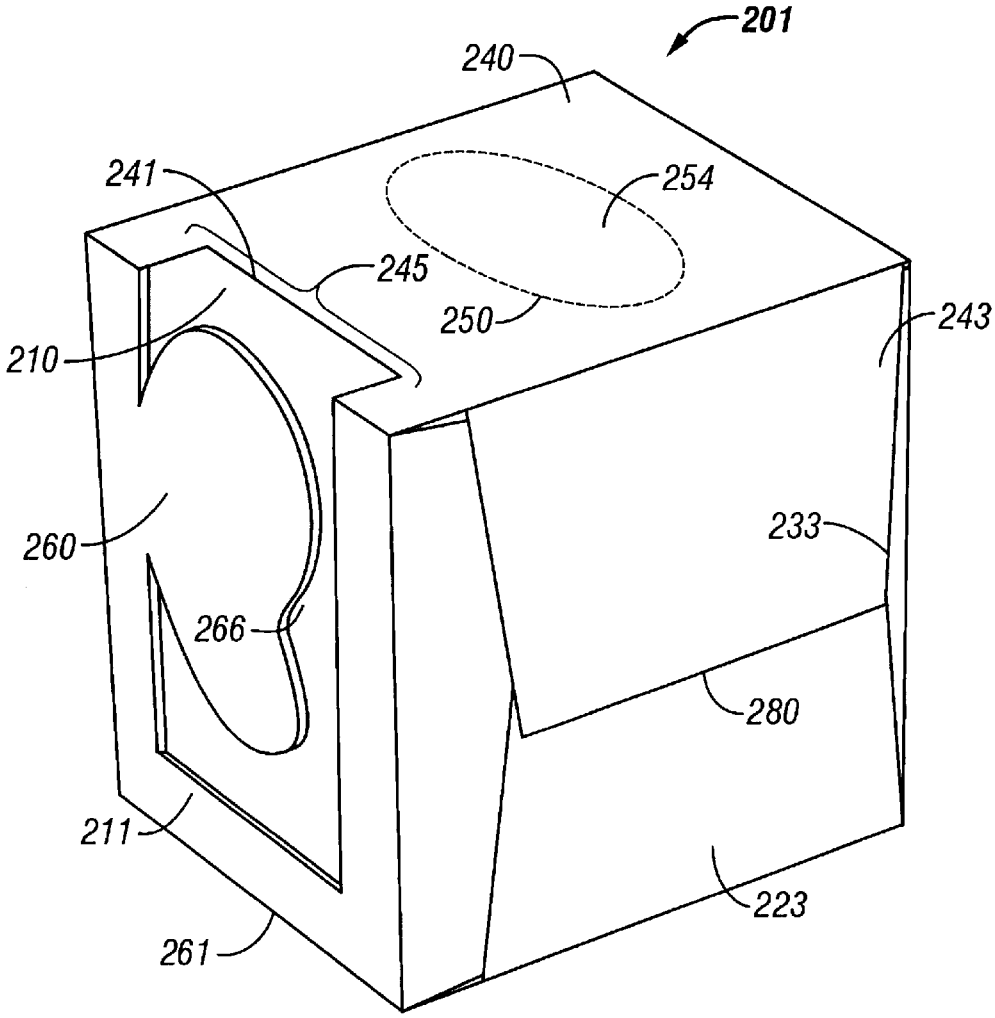
FIG. 5 is a perspective view of an improved display device and foldable carton of the present invention in an upright configuration.
Figure 6:
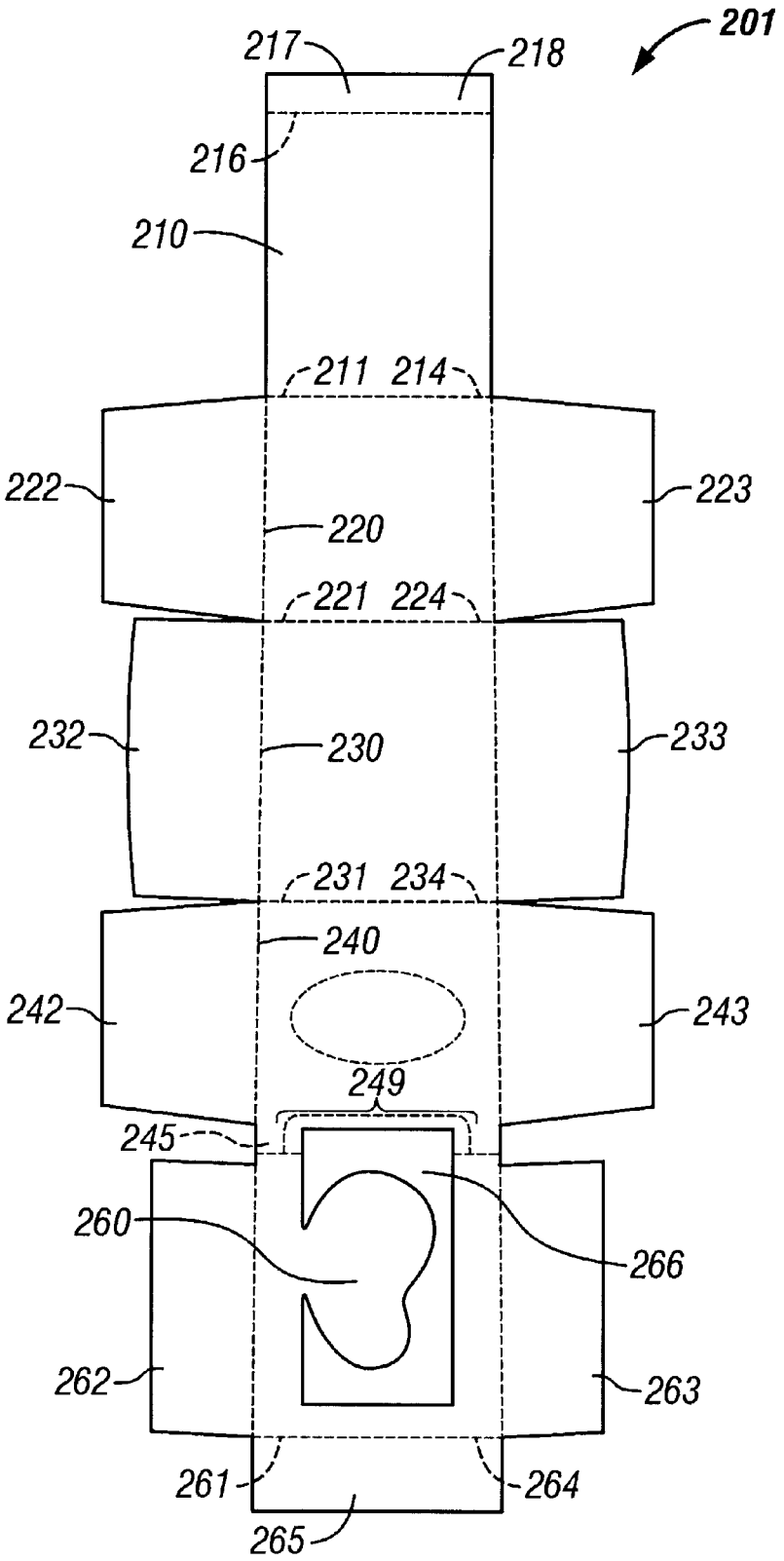
FIG. 6 is a plan view of an improved display device and foldable carton of the present invention in a blank configuration.

Another improved display device and folding carton 201 is depicted in a perspective view in FIG. 5. A plan view of carton 201 in a fully extended, relatively flat configuration is shown in FIG. 6. Elements in carton 201 which correspond to those described above with respect to carton 100, have element numbers which are greater by 200. For example, front panel 210 of carton 201 corresponds to top panel 10 of carton 1. As another example, cutout area 266 of carton 201 corresponds to cutout area 66 of carton 1.

Figure 7:
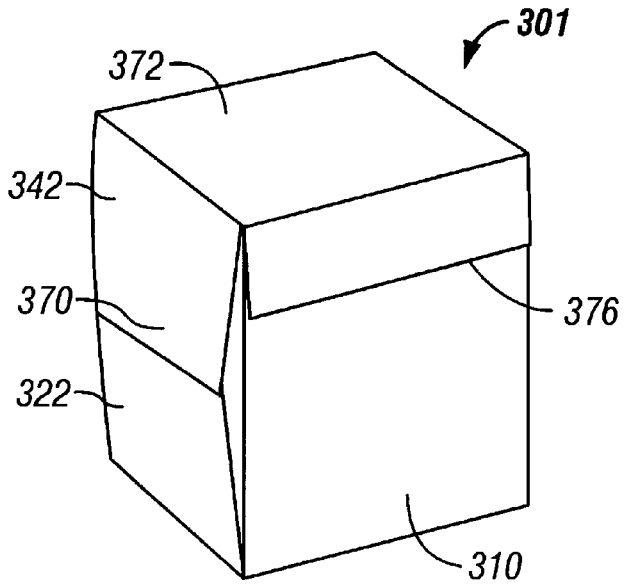
FIG. 7 is a perspective view of an improved display device and foldable carton of the present invention in upright closed configuration.
Figure 8:
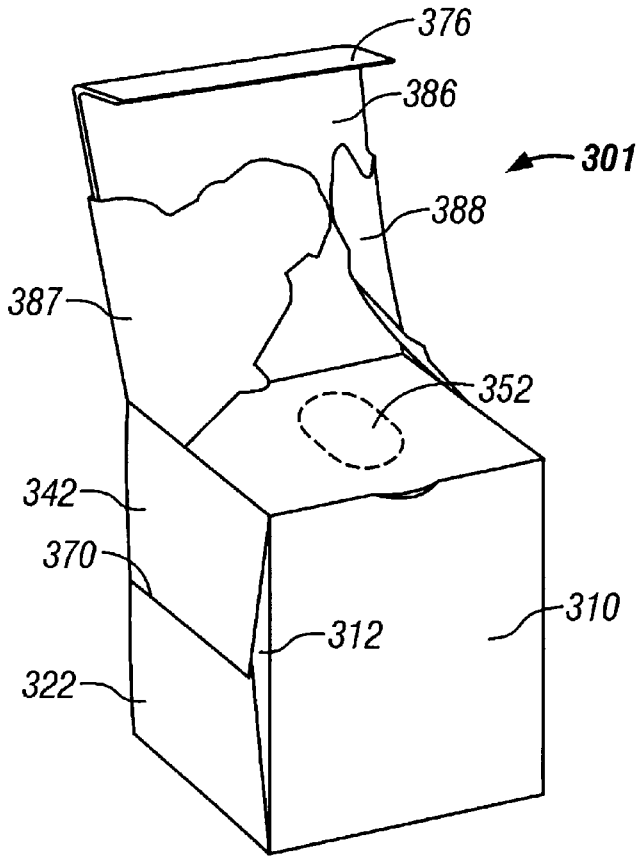
FIG. 8 is a perspective view of an improved display device and foldable carton of the present invention in an upright pop-up configuration.
Figure 9:
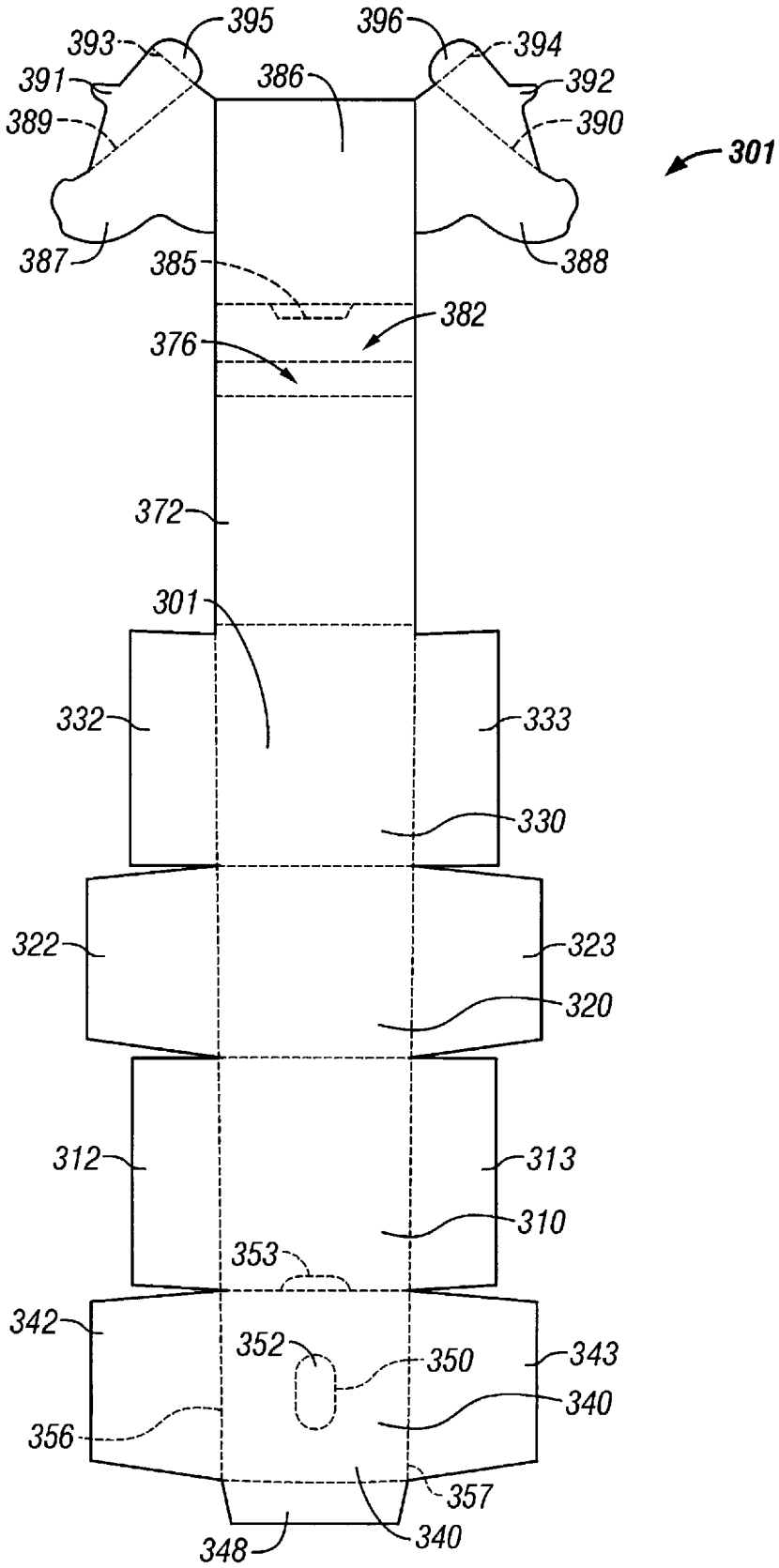
FIG. 9 is a plan view of an improved display device and foldable carton of the present invention in a blank configuration.

Yet another improved display device and folding carton 301 is depicted in closed perspective view in FIG. 7, and in a pop-up perspective view in FIG. 8. A plan view of carton 301 in a fully extended, relatively flat configuration is shown in FIG. 9. Elements in carton 301 which correspond to those described above with respect to carton 100, have element numbers which are greater by 300. For example, front panel 310 of carton 301 corresponds to top panel 10 of carton 1. As another example, bottom panel closure flap 322 of carton 301 corresponds to bottom panel closure flap 22 carton 1.

Turning now to FIG. 6, outer lid 372 closes carton 301 and is held in place by outer tongue 376. The contents of Carton 301 are securely maintained and protected.

FIG. 7 depicts inner lid 386 and outer tongue 376 in pop-up position, with the contents of carton 301 secured only by detachable portion 352 and frangible web 350. Proximal pop-up panels (387 and 388) and distal pop-up panels are shown in fully raised position. The shape and colors of the pop-up panels (387,388, 391 and 392) can be utilitarian or decorative.

It can be seen in FIG. 9 that carton 301 in blank configuration includes top panel 340 foldably joined to front panel 310, which is foldably joined to bottom panel 320, which is foldably joined to rear panel 330. Each of the panels (340, 310, 320 and 330) include laterally extending closure flaps (342, 343, 312, 313, 322, 323, 332 and 333, respectively). Top panel 340 also includes an outwardly extending top panel closure flap 348, a frangible web 350, a detachable portion 352 and locking slots (356 and 357).

Rear panel 330 is also foldably joined to outer lid panel 372, which is foldably joined to outer tongue panel 376, which is foldably joined to inner tongue panel 382, which is foldably joined to inner lid panel 386. Two laterally extending proximal pop-up panels (387 and 388) are foldably joined to opposite edges of inner lid panel 386. Distal panel score lines (389 and 390) foldably join proximal pop-up panels (387 and 388) to distal pop-up panels (391 and 392). Proximal score lines (393 and 394) foldably join distal pop-up panels (391 and 392) with locking tabs (395 and 396), respectively. All of these panels are preferably formed at one time from a single sheet of foldable material.

Top panel locking tab 353 mates with inner tongue locking slot 385 to hold outer lid 372 in closed position, as shown in FIG. 7. Releasing top panel locking tab 353 and raising inner lid panel 386 and outer lid panel 372 reveals the pop-up panels (387, 388, 391 and 392).

In order to lock the pop-up panels (387, 388, 391 and 392)in pop-up position, folds are made between the tongue panels (382 and 376) at the proximal score lines 389 and 390) and at the distal score lines (393 and 394). The pop-up locking tabs (395 and 396) are inserted into the respective top panel locking slots (356 and 357).

Figure 10:
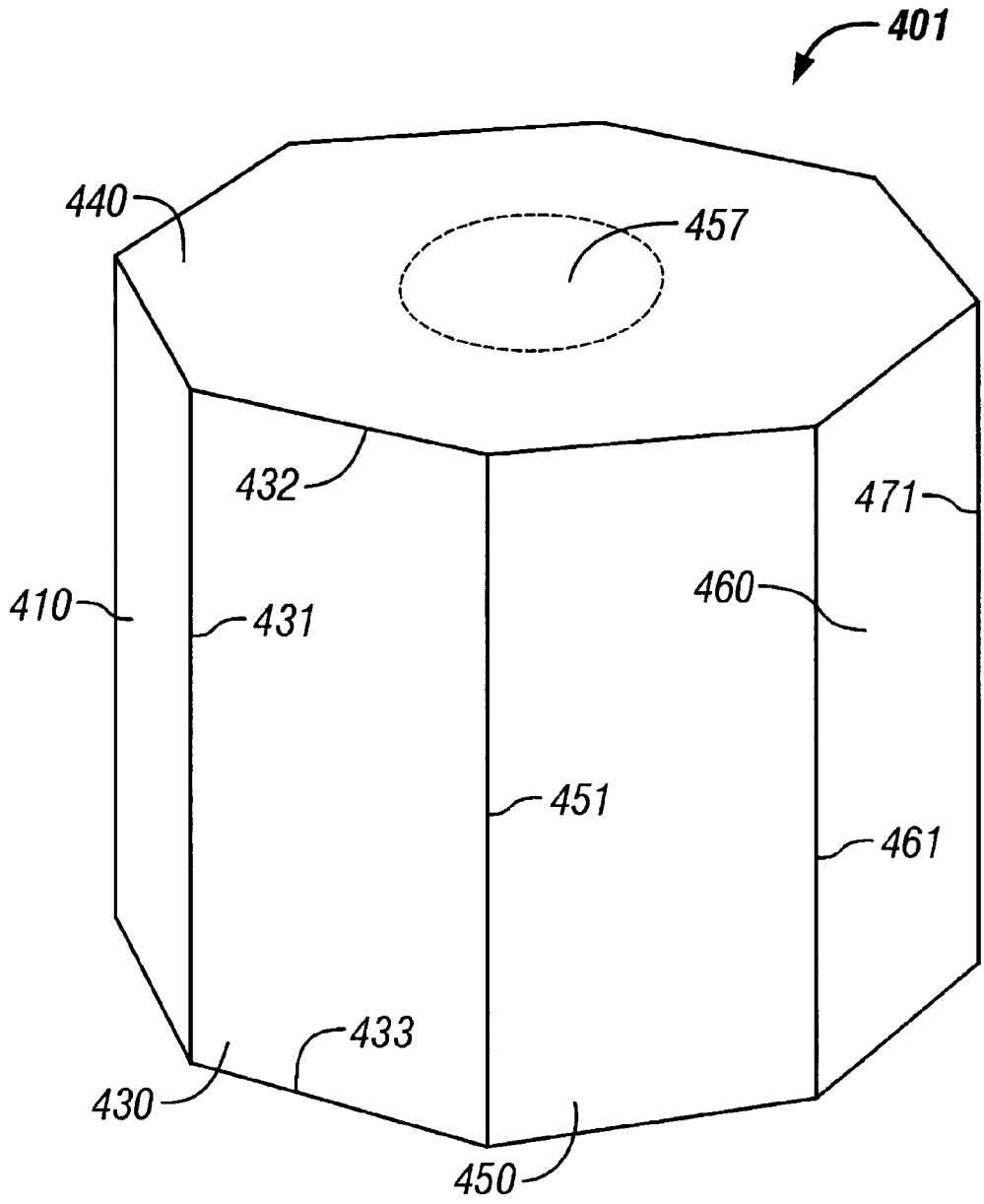
FIG. 10 is a perspective view of an improved display device and foldable carton of the present invention in an upright configuration.

Still another improved display device and folding carton 401 is shown in perspective view in FIG. 10. Carton 401 is preferably formed at one time from a single sheet of foldable material. While carton 401 is a right, octagonal, truncated prism, cross-sectional shapes other than octagonal are contemplated. Top panel 440 of carton 401 defines a portal 457, which may be obstructed at times by a detachable portion (not shown).

Figure 11:
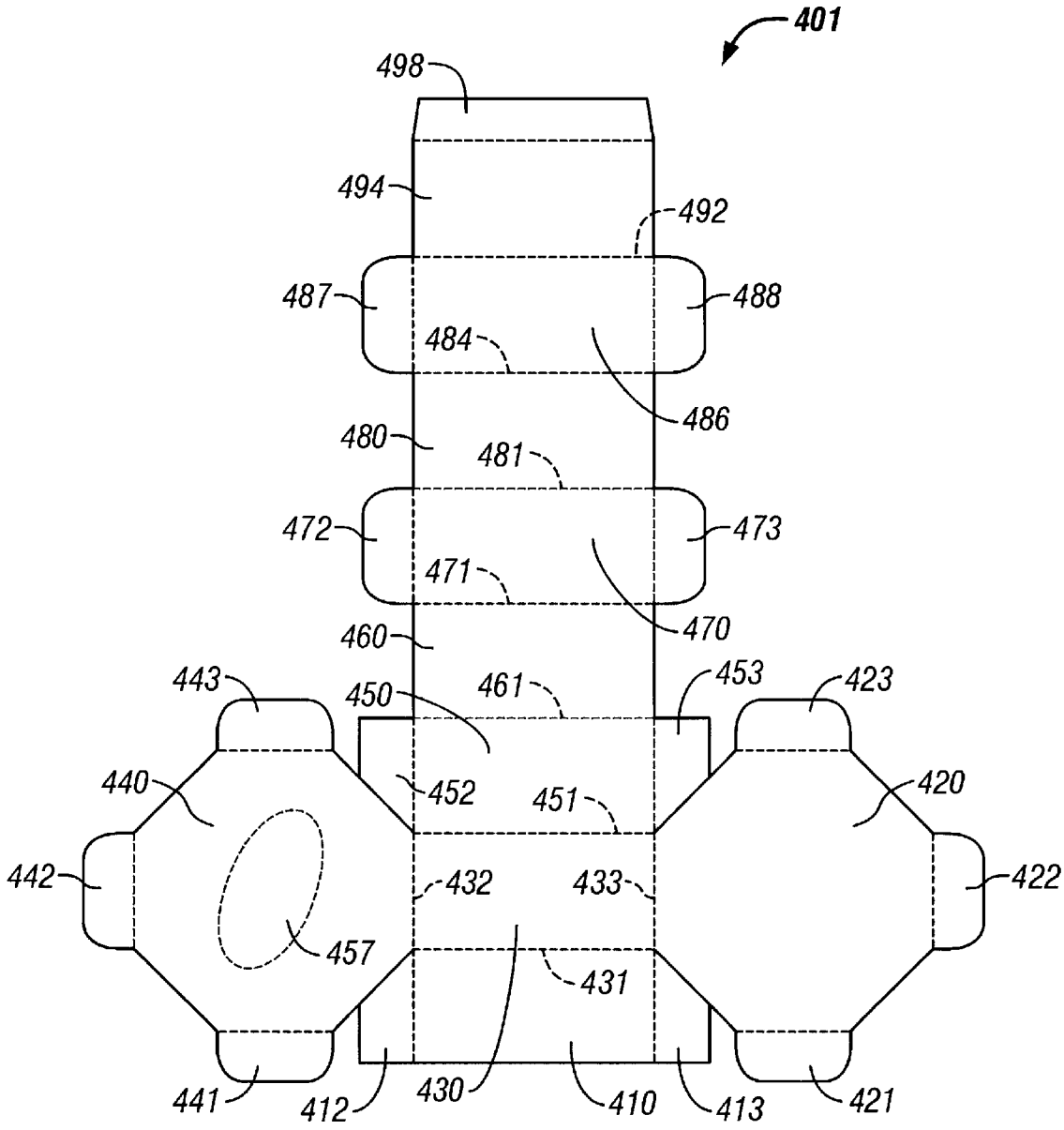
FIG. 11 is a plan view of an improved display device and foldable carton of the present invention in a blank configuration.

Turning now to FIG. 11, it can be seen that the sides of carton 401 are formed by eight side panels (410, 430, 450, 460, 470, 480, 486 and 492). The side panels are foldably joined in series by seven axial score lines (431, 451, 461, 471, 481, 484 and 492). Side panel 494 includes an outwardly extending closure flap 498 for foldably joining to side panel 410. Every other side panel (410, 450, 470 and 486) includes a pair of laterally extending closure flaps (412, 413, 452, 453, 472, 473, 487 and 488, respectively). From each of the pairs of side panel closure flaps, one of the closure flaps is adhesively attached to top panel 440, and the other of the closure flaps is adhesively attached to bottom panel 420.

Top panel 440 is foldably joined to side panel 430 at score line 432. Top panel 440 includes three outwardly extending closure flaps (441, 442 and 443) for adhesively attaching to side panels 460, 480 and 492, respectively.

Bottom panel 420 is foldably joined to side panel 430 at score line 433. Top panel 440 includes three outwardly extending closure flaps (421, 422 and 423) for adhesively attaching to side panels 460, 480 and 492, respectively.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

That which is claimed is:

1. An improved display device and folding carton, which comprises:

a front panel having a top edge, a substantially linear score line along the top panel top edge, a front panel closure flap extending outwardly from the front panel top edge, a bottom edge, and a substantially linear score line along the front panel bottom edge;

a bottom panel having a rear edge, a pair of laterally extending bottom panel closure flaps, and a substantially linear score line along the bottom panel rear edge, the bottom panel being foldably connected to the front panel along the front panel bottom edge score line;

a rear panel having a top edge, a pair of laterally extending rear panel closure flaps, and a substantially linear score line along the rear panel top edge, the rear panel being foldably connected to the bottom panel along the bottom panel rear edge score line;

a top panel having a front edge, a plurality of support tabs extending outwardly from the top panel front edge, a bottom edge, a frangible web which circumscribes and defines a detachable portion and circumscribes and defines a portal substantially obstructed by the detachable portion, a pair of laterally extending top panel closure flaps, each of the support tabs having an outward edge terminating in a score line, and the front panel closure flap being of suitable size and strength for attaching and foldably connecting the front panel to the top panel along the top panel front edge score line; and a projecting panel having a bottom edge, a pair of laterally extending projecting panel closure flaps, a substantially linear score line along the projecting panel bottom edge, and a support flap extending outwardly from the projecting panel bottom edge, the projecting panel being foldably connected to at least one of the plurality of support tabs along the score line of the respective support tab, the projecting panel support flap being of suitable size and strength for attaching the projecting panel support flap to the bottom panel so as to align the projecting panel in a spaced apart from and substantially parallel position relative to the front panel.

2. The improved display device and folding carton of claim 1 in which the projecting panel includes a projecting panel top edge which is not substantially linear and, together with the top panel front edge and the plurality of support tabs, defines a cutout area.

3. The improved display device and folding carton of claim 1 in which at least one of the top panel closure flaps carry an adhesive strip.

4. The improved display device and folding carton of claim 1 in which the front panel closure flap attaches and foldably connects the front panel to the top panel along the top panel front edge score line and the projecting panel support flap is attached to the bottom panel.

5. The improved display device and folding carton of claim 4 in which the bottom panel and the rear panel are substantially coplanar.

6. The improved display device and folding carton of claim 4 in which the top panel and the rear panel are substantially coplanar.

7. The improved display device and folding carton of claim 4 in which the front panel is in a spaced apart from and substantially parallel position relative to the rear panel.

8. An improved display device and folding carton, which comprises:

two end panels;

a front panel a bottom panel;

a rear panel, and;

a top panel having a front edge, a plurality of support tabs extending outwardly from the top panel front edge, each of the support tabs having an outward edge terminating in a score line; and a projecting panel having a bottom edge and a support flap extending outwardly from the projecting panel bottom edge, the projecting panel being foldably connected to at least one of the plurality of support tabs along the score line of the respective support tab, the projecting panel support flap being of suitable size and strength for attaching the projecting panel support flap to the bottom panel so as to align the projecting panel in a spaced apart from and substantially parallel position relative to the front panel;

wherein the above-described panels are formed in one piece of material and interconnected with each other to form a substantially continuous carton in the shape of a right, rectangular, truncated prism.

9. The improved display device and folding carton of claim 8 which the top panel comprises a frangible web which circumscribes and defines a detachable portion and circumscribes and defines a portal substantially obstructed by the detachable portion.

10. The improved display device and folding carton of claim 8 in which the projecting panel includes a projecting panel top edge which is not substantially linear and, together with the top panel front edge and the plurality of support tabs, defines a cutout area.

11. The improved display device and folding carton of claim 8 in which at least one of the front panel, the bottom panel, the rear panel, and the top panel include a pair of closure flaps extending laterally from opposite sides of the respective one of the panels.

12. The improved display device and folding carton of claim 8 in which the front panel closure flap attaches and foldably connects the front panel to the top panel along the top panel front edge score line and the projecting panel support flap is attached to the bottom panel.

13. The improved display device and folding carton of claim 12 which the bottom panel and the rear panel are substantially coplanar.

14. The improved display device and folding carton of claim 13 in which the top panel and the rear panel are substantially coplanar.

15. The improved display device and folding carton of claim 13 in which the front panel is in a spaced apart from and substantially parallel position relative to the rear panel.

16. An improved display device and folding carton, which comprises:

two end panels;

a front panel a top panel;

a rear panel, and;

a bottom panel having a front edge, a plurality of support tabs extending outwardly from the bottom panel front edge, each of the support tabs having an outward edge terminating in a score line; and a projecting panel having a top edge and a support flap extending outwardly from the projecting panel top edge, the projecting panel being foldably connected to at least one of the plurality of support tabs along the score line of the respective support tab, the projecting panel support flap being of suitable size and strength for attaching the projecting panel support flap to the top panel so as to align the projecting panel in a spaced apart from and substantially parallel position relative to the front panel;

wherein the above-described panels are formed in one piece of material and interconnected with each other to form a substantially continuous carton in the shape of a right, rectangular, truncated prism.

17. A blank made in one piece from a sheet of material and adapted to be folded in to an improved display device and folding carton, the blank comprising:

a front panel having a top edge, a substantially linear score line along the top panel top edge, a front panel closure flap extending outwardly from the front panel top edge, a bottom edge, and a substantially linear score line along the front panel bottom edge;

a bottom panel having a rear edge, a pair of laterally extending bottom panel closure flaps, and a substantially linear score line along the bottom panel rear edge, the bottom panel being foldably connected to the front panel along the front panel bottom edge score line;

a rear panel having a top edge, a pair of laterally extending rear panel closure flaps, and a substantially linear score line along the rear panel top edge, the rear panel being foldably connected to the bottom panel along the bottom panel rear edge score line;

a top panel having a front edge, a plurality of support tabs extending outwardly from the top panel front edge, a bottom edge, a frangible web which circumscribes and defines a detachable portion and circumscribes and defines a portal substantially obstructed by the detachable portion, a pair of laterally extending top panel closure flaps, each of the support tabs having an outward edge terminating in a score line, and the front panel closure flap being of suitable size and strength for attaching and foldably connecting the front panel to the top panel along the top panel front edge score line; and a projecting panel having a bottom edge, a pair of laterally extending projecting panel closure flaps, a substantially linear score line along the projecting panel bottom edge, and a support flap extending outwardly from the projecting panel bottom edge, the projecting panel being foldably connected to at least one of the plurality of support tabs along the score line of the respective support tab, the projecting panel support flap being of suitable size and strength for attaching the projecting panel support flap to the bottom panel so as to align the projecting panel in a spaced apart from and substantially parallel position relative to the front.

18. The blank of claim 17 in which the projecting panel includes a projecting panel top edge which is not substantially linear and, together with the top panel front edge and the plurality of support tabs, defines a cutout area.

19. The blank of claim 17 in which at least one of the top panel closure flaps carry an adhesive strip.

20. The blank of claim 17 in which the projecting panel support flap is attached to the bottom panel.

21. The blank of claim 17 in which the front panel closure flap attaches and foldably connects the front panel to the top panel along the top panel front edge score line.

22. The improved display device and folding carton of claim 21 in which the bottom panel and the rear panel are substantially coplanar.

23. The improved display device and folding carton of claim 21 in which the top panel and the rear panel are substantially coplanar.

24. The improved display device and folding carton of claim 21 in which the front panel is in a spaced apart from and substantially parallel position relative to the rear panel.

* * * * *